US005507140A

United States Patent [19]

Mann et al.

[11] Patent Number: 5,507,140

[45] Date of Patent: Apr. 16, 1996

[54] EXTERNAL DOUBLE-JAW BRAKE FOR A SPINDLE OF A SPINNING MACHINE

[75] Inventors: Peter Mann, Süssen; Jakob Bothner; Gerd Stölzner, both of Göppingen, all of Germany

[73] Assignee: Zinser Textilmaschinen GmbH, Ebersbach/Fils, Germany

[21] Appl. No.: 353,542

[22] Filed: Dec. 9, 1994

[30] Foreign Application Priority Data

Dec. 10, 1993 [DE] Germany ..... 43 42 275.6

[51] Int. Cl.[6] ..... D01H 13/00

[52] U.S. Cl. ..... 57/88; 242/422.9

[58] Field of Search ..... 57/88; 242/422.9

[56] References Cited

U.S. PATENT DOCUMENTS

| | | | |
|---|---|---|---|
| 1,786,252 | 12/1930 | Magrath | 57/88 |
| 2,928,230 | 3/1960 | Stahlecker | 57/88 |
| 3,044,248 | 7/1962 | Hall | 57/88 |
| 3,060,671 | 10/1962 | Tetreault | 57/88 |
| 3,122,875 | 3/1964 | Swift . | |
| 3,406,512 | 10/1968 | Stahlecker | 57/88 |

FOREIGN PATENT DOCUMENTS

| | | | |
|---|---|---|---|
| 0456996 | 11/1991 | European Pat. Off. . | |
| 580266 | 1/1994 | European Pat. Off. | 57/88 |
| 930034 | 5/1960 | United Kingdom . | |

*Primary Examiner*—Joseph J. Hail, III
*Attorney, Agent, or Firm*—Herbert Dubno

[57] ABSTRACT

A four-part spindle brake has a support body and cover insertable through an opening in a wall of a spindle rail of a spinning machine and receiving between them a brake body whose two levers are joined centrally by film hinges and are formed as outwardly and downwardly-extending pins received in bearing bosses of the cover and the support body. An actuating plate suspended by horizontal pivot pins on the support body has a spreader engageable between the levers for causing the jaws of the brake body to close upon the spindle.

21 Claims, 4 Drawing Sheets

EXTERNAL DOUBLE-JAW BRAKE FOR A SPINDLE OF A SPINNING MACHINE

FIELD OF THE INVENTION

The present invention relates to an external double-jaw brake for a spinning spindle and, more particularly, to a brake which is mounted in a wall of a cover member, shield or enclosure of a spindle rail and has a brake body formed with two centrally interconnected brake levers which, upon spreading at one side, has its jaw pressed against the spindle.

BACKGROUND OF THE INVENTION

Spindle brakes of the aforedescribed general type can be provided on spinning machines for each of the spindles of a spindle rail. Brakes of this type are described, for example, in EP 0 456 996 A1.

In this system, the brake body is substantially U-shaped and is retained in a wall of the covering of the spindle rail and the spreading device is displaced in a spreading direction between shanks of the brake body perpendicular to the axis of the spindle. A carrier member is mounted in the wall of the spindle rail enclosure and the brake body is mounted thereon and the carrier member can also provide a guide for the spreading device. The central region of the brake body can form a pivot joining the two brake levers. This prior art construction is composed of a multiplicity of individual parts which must be premounted before the assembly is affixed in the covering.

Another spindle brake is described in U.S. Pat. No. 3,122,875 and comprises a support body, a brake body, a closable cover and a brake lever. It also is comprised of a number of individual parts which requires a time-consuming and relatively expensive mounting.

OBJECTS OF THE INVENTION

It is the principal object of the present invention, therefore, to provide an improved spindle brake which, by comparison with the prior art brakes, has a reduced number of parts, wherein the parts which are provided can be easily replaced, and which can be assembled and fabricated at substantially lower cost.

Another object of the invention is to provide a spindle brake particularly suited for mass production whereby such brakes can be readily mounted and the parts replaced on multispindle spinning machines without drawbacks of earlier brake devices.

It is still another object of the invention to provide a reliably-acting, easily-mounted spindle brake with a minimum number of parts.

SUMMARY OF THE INVENTION

These objects and others are attained, in accordance with the invention by providing on a spindle rail of a spinning machine, a support body and a cover which can be retained on the support body by appropriate detents, and on which a brake body is mounted for pivotal movement about a first vertical pivot pin. The support body and the cover body can have respective vertical first journals engageable with this pin and the second brake lever can have its fulcrum as a second vertical pin engageable with second pivot bearings on the support body and the cover body, also oriented vertically and parallel to the first. The actuating plate which is suspended on the support body and has a spreader capable of being forced between the brake levers, cams these apart at the spreader to press the brake jaws against the spindle.

More particularly, an external double-jaw brake for a spindle of a spinning machine can comprise:

an external double-jaw brake for a spindle of a spinning machine having a spindle rail having a row of spindles and a wall extending along the rail, the brake comprising:

a support body configured to project through an opening in the wall opposite a respective spindle and provided with detents securing the support body to the wall and a pair of horizontally spaced vertical first journals;

a brake body received on the support body and comprised of a pair of mutually opposite brake levers fulcrummed at respective first and second pins on opposite sides of the brake body and interconnected at a central region of the brake body, the first pins being received in the first journals of the support body, the levers having at ends turned toward the respective spindle, respective jaws juxtaposed with and engageable with the respective spindle;

a cover overlying the brake body, extending through the opening, secured to the wall by respective detents and engaging the support body, the cover being formed with second journals aligned with the first journals and receiving the second pins; and an actuating plate suspended in horizontal pivot bearings of the support body and provided with a spreader engageable between opposite ends of the levers for spreading the levers and pressing the jaws against the respective spindle.

As a result, the outer double-jaw brake according to the invention can consist of only four distinct parts, namely, the one-piece brake body comprised of the two brake levers, the support body, the cover which can be applied thereto and the actuating plate, with its spreading device. Additional fastening elements are unnecessary. The brake is maintenance-free since any damaged parts including the actuating plate or the brake body, can easily be replaced in a minimum of time.

Because of the configuration of the spreading device and the engagement surfaces of the brake body, a well-defined break in the force-displacement curve of the brake operation can be obtained so that excellent braking results are obtained without excessive force.

By appropriate selection of the configurations of the brake body and the actuating surfaces, the brake can be locked against the spindle and when release of the spindle is desired, lifting of the actuating plate can free the spindle.

According to a feature of the invention, the support body can have mutually-opposite guides for the respective levers of the one-piece injection-molded brake body. Each of these guides can comprise two spaced-apart vertical members including a relatively forwardly-disposed member in a vicinity of the respective vertical first journal.

The levers of the brake body can be interconnected at the central region by at least one film hinge and, rearwardly of the film hinge, each of the levers can have a resilient shank formed with a respective attack surface engageable by the spreader.

In a further advantageous configuration, two film hinges are provided at the central region to interconnect the levers. The attack surfaces of the levers can be inclined at an acute angle to one another and each of the attack surfaces can be angled and can have a relatively shallowly-inclined region adjoining a more steeply inclined region.

Each of the levers can have, according to yet another feature of the invention, a shank rearwardly of the respective pins formed externally with an outwardly convex spring element terminating forwardly at a respective groove receiving the aforementioned forwardly-disposed member, centrally engaging the other member and reaching rearwardly substantially to the other end of the respective shank.

The jaws can be formed by respective brake elements fitted into the respective levers. The actuating plate can have an upper region provided with a pair of horizontal trunnions received in the pivot bearings for suspending the actuating plate therefrom. The spreader can have a block formed on a back of the actuating plate and inclined to a forward plane while extending downwardly to a level of the attack surfaces. A front of the actuating plate can extend downwardly beyond an underside of the support body.

The block can have actuating flanks extending along vertical edges of the block and engageable with the attack surfaces for camming engagement therewith. The flanks can be tapered or inclined generally conically to one another and have retention of the brake as a holding brake, the attack surfaces can have undercuts while the actuating plate has ribs engageable in the undercuts. It has been found to be advantageous to provide the actuating plate above the trunnions with a further actuating surface.

The support body can have the configuration of a U-shaped frame provided with the detents of the support body at a bottom of the frame. The cover and the support body can have converging surfaces tapering forwardly in a direction of insertion of the cover and the support body through the opening. The support body and cover can have mutually-engageable pin and recess formations interlocking the cover with the support body. The detents can be spring tongue pairs on the cover and the support body, lying in a common vertical plane.

It has been found to be advantageous to have the cover extend over the central region of the brake body substantially to the other ends of the levers and to provide the cover with a pair of guide formations extending through openings in the actuating plate above the trunnions.

BRIEF DESCRIPTION OF THE DRAWING

The above and other objects, features, and advantages will become more readily apparent from the following description, reference being made to the accompanying drawing in which.

SPECIFIC DESCRIPTION

Figure 11:
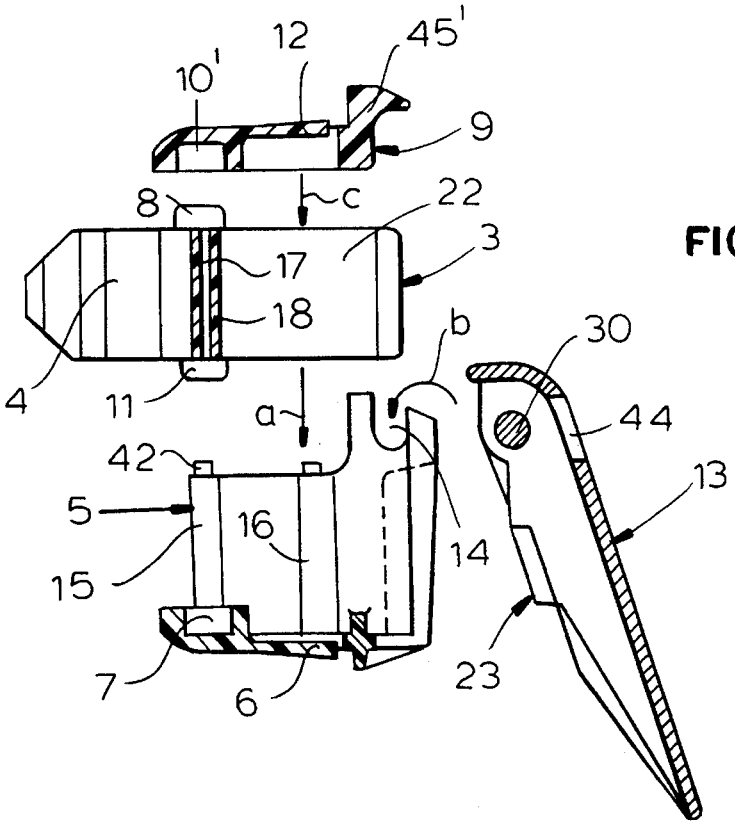
FIG. 11 is an exploded view, partly in section and partly broken away, of the brake according to the invention.
Figure 12:
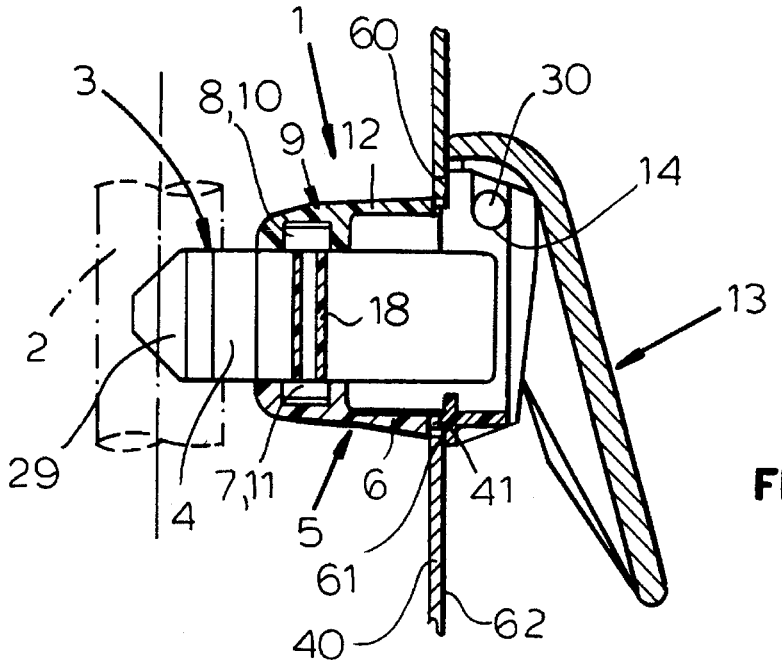
FIG. 12 is a cross sectional view corresponding to a section along the line XII—XII of FIG. 13, illustrating the brake assembled and in place.

Referring first to FIGS. 11 and 12, it can be seen that basically a spindle brake 1 according to the invention comprises four parts, namely, a brake body 3, a support body 5, a cover 9 and an actuating plate 13.

From FIG. 11 it will be apparent that in a first step (a) the brake body 3 is set into the support body 5. Then in a second step (b), the actuating plate 13 is suspended in the support body 5. Finally the cover 9 is applied to the support body 1 in step (c) to complete the assembly.

Figure 13:
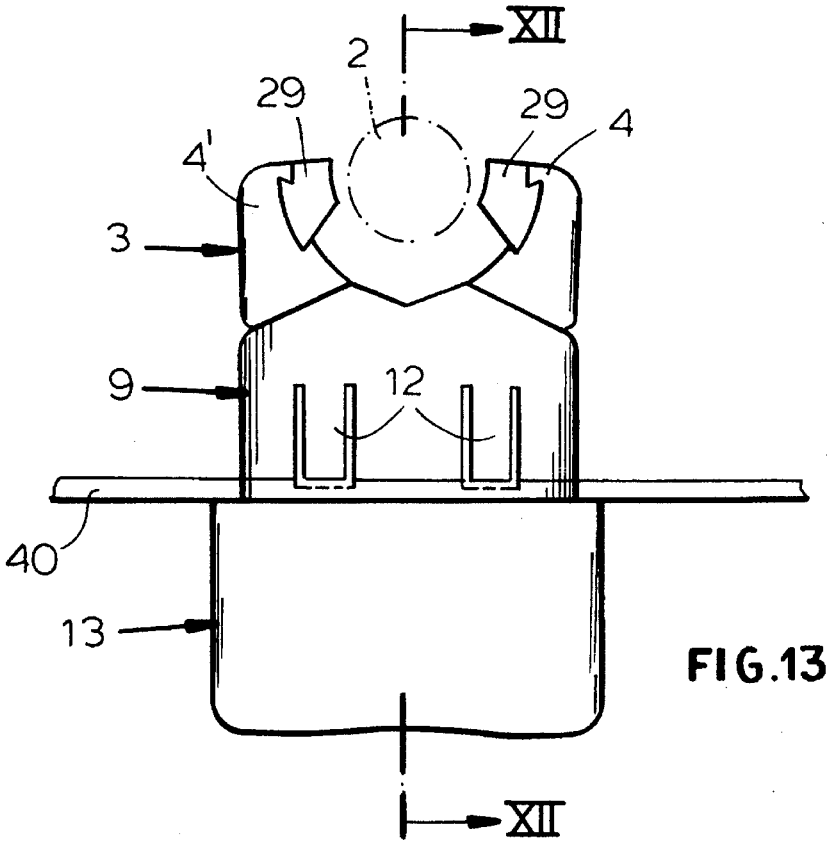
FIG. 13 is a plan view of the double-jaw brake mounted on a wall of a spindle rail of a spinning machine.

From FIG. 12 it will be apparent that the external double-jaw brake 1 can straddle a spinning machine spindle 2 mounted on a spindle rail which has a wall or shield 40 extending therealong and provided with an opening 41 into which a housing consisting of the cover 9 and the support 5 can be inserted, these housing elements having detents 6 and 12 (FIG. 13) which are compressed for insertion through the opening 41 but engage behind the wall 40 when the brake is seated thereagainst. Spaced from the detents 6 and 12, the housing can have surfaces 6 and 61 which rest against the outer face 62 of the wall 40.

FIGS. 1–10 show the individual elements of the four-piece brake in greater detail.

Figure 1:
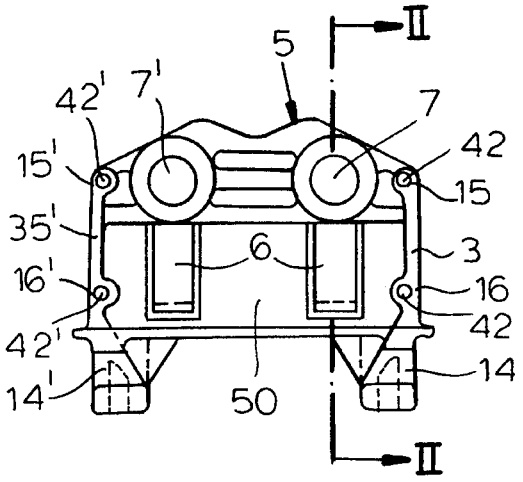
FIG. 1 is a plan view of the support body with the cover and brake body removed and dismounted from the plate or wall upon which the spindle brake is usually mounted.
Figure 2:
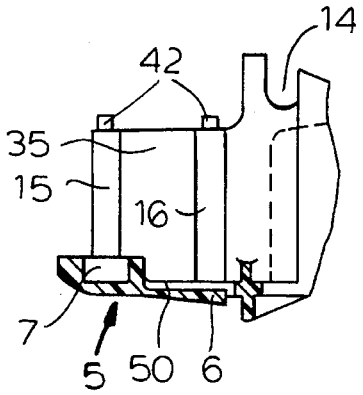
FIG. 2 is a section taken along the line II—II of FIG. 1.

FIGS. 1 and 2, for example, show the support body 5 to be substantially U-shaped and upwardly and forwardly open, and having a base plate 50 from which two spaced-apart parallel spring detents 6 project downwardly and formed with two vertical bearing bosses 7 and 7'.

A pair of upwardly-extending shanks 35 and 35' are formed unitarily with the base plate 50, i.e. can be injection-molded unitarily therewith and are formed at their upper edges with pins 42 and 42'. These four pins lie in regions of four vertical ribs 15, 16 and 15', 16'. In addition, the shanks 35 and 35' are formed with two horizontally disposed pivot bearings 14 and 14'.

Figure 3:
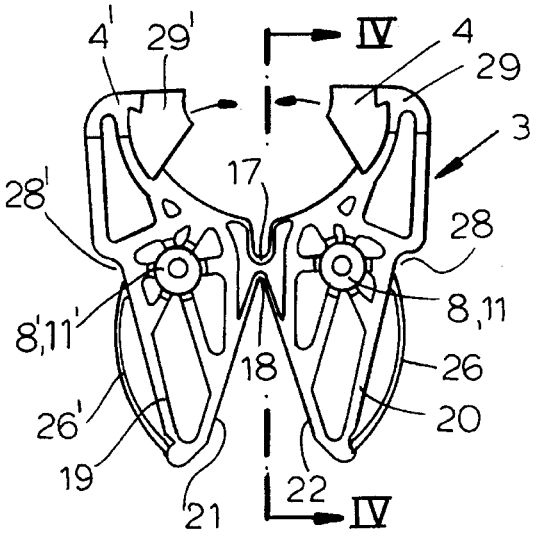
FIG. 3 is a plan view of the brake body.
Figure 4:
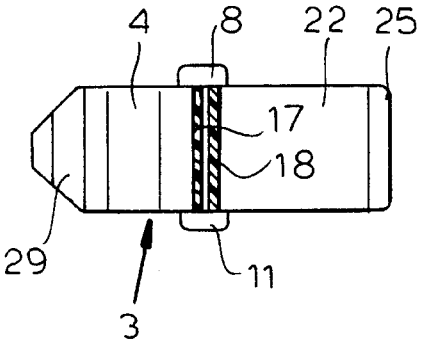
FIG. 4 is a section taken along the line IV—IV of FIG. 3.

FIGS. 3 and 4 show the brake body 3 in detail.

The brake body 3 is comprised of two bracket levers 4 and 4' injection molded in one piece so as to be held together in their central regions by two opposite film hinges 17 and 18.

The two film hinges 17 and 18 extend into two shanks 19 and 20 which, along their external surfaces are provided with outwardly convex spring elements 26 and 26'. At a front region of the two spring elements 26 and 26' respective grooves 28 and 28' are formed in each part of the body 3.

The shanks 19 and 20 are formed internally with respective attack surfaces 21 and 22 engageable by a spreading device 23 to be described in greater detail hereinafter. As FIG. 3 shows, the attack surfaces 21 and 22 of the shanks 19 and 20 include an acute angle to one another. From FIG. 5 it can be seen that the attack surfaces 21 and 22 themselves can be angled with shallow incoming regions 24 and 25 and steeper in regions 26 and 27.

Figure 5:
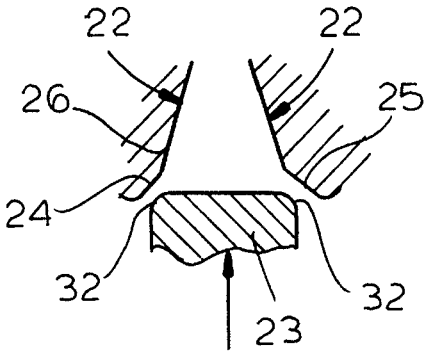
FIG. 5 is a diagram of the relationship between the contact surfaces of the spreader and the brake body according to one embodiment.

Thus as can be seen from FIG. 5, when the spreading device 23 with its generally conical acute surface 32 is moved in the direction of the arrow, initially the shallower contact regions 24 and 25 is engaged and then only later are the steeper regions 26 and 27 cammed outwardly by the spreading device. This ensures a sharp break in the forced-displacement line, guaranteeing reliable brake operation without necessitating high pressures applied to the actuator.

The actuation of the spreader 23 swings the brake jaws 4 and 4' as can be seen from FIG. 3 in the direction of the arrows toward one another and thus springs the brake elements or shoes 29 and 29' which are set into the jaws 4 and 4' against the spindle 2 (FIG. 12) to effect the brake action.

FIGS. 3 and 4 also show that at the central region of the brake body 3, each of the levers has vertical bearing pins 8, 8' or 11, 11'.

Upon the mounting of the brake body 3 in step (a) in the support body 5, the two lower bearing pins 11 and 11' are engaged into the bearing bosses 7, 7' of the support body 5. Simultaneously the vertical ribs 15 and 15' of the support body 5 are received in the grooves 28, 28' of the brake body 3. The two spring elements 26 and 26' rest in the space between the vertical ribs 15, 16 or 15', 16'. This ensures reliable mounting of the brake body within the support body 5.

Figure 6:
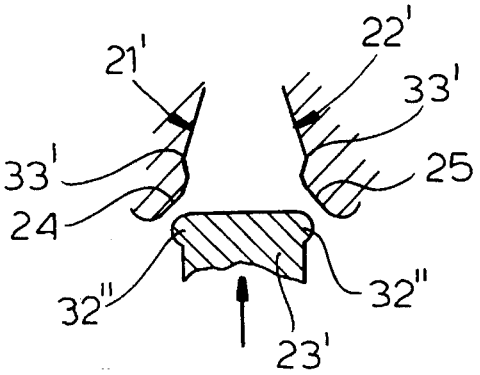
FIG. 6 is a diagram similar to FIG. 5 in another embodiment.

The modified configuration of the attack surfaces shown in FIG. 6 allows the double-jaw brake to function as a retaining brake. In this case, the attack surfaces 21' and 22' have undercuts 33' and the actuating surface of the spreader 23 has beads 32" which can engage in the undercuts 33' and, under the spring action of the brake levers, can be gripped in the undercuts. The brake is held engaged with the spindle.

To release this form-locked retention of the spreader 23, the actuating plate 13 carrying it must be lifted to restore the spreader 23' forcibly into its starting position.

Figure 7:
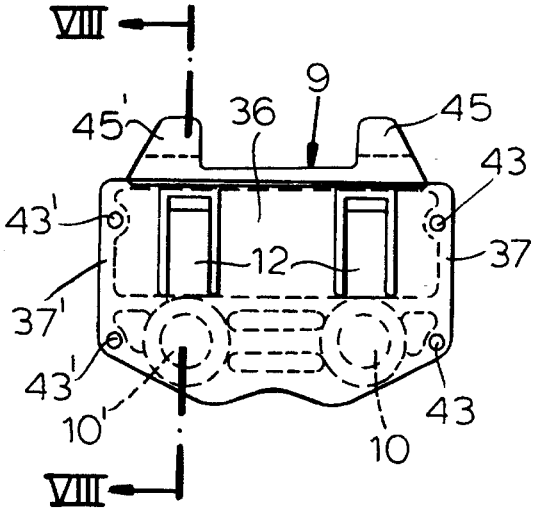
FIG. 7 is a plan view of the cover.
Figure 8:
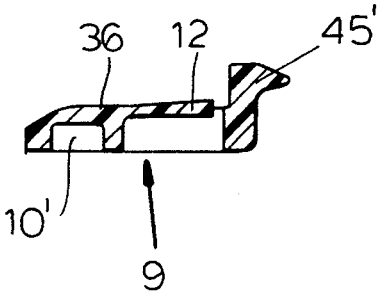
FIG. 8 is a cross sectional view taken along the line VIII—VIII of this cover.
Figure 9:
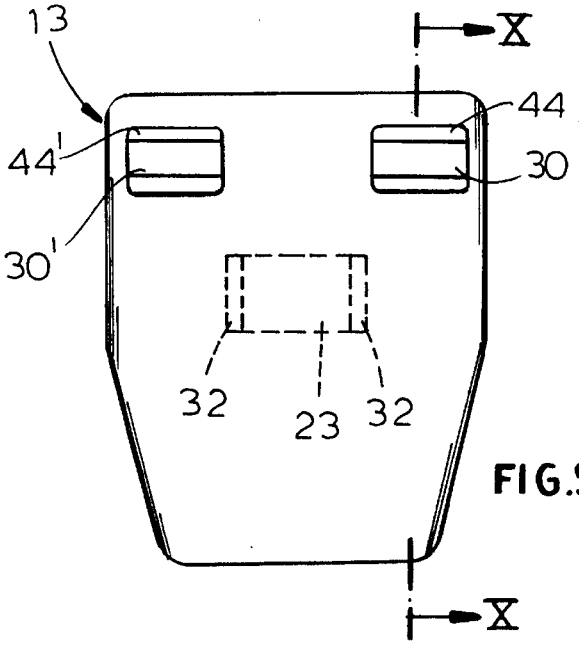
FIG. 9 is a front view of the actuating plate.

FIG. 7 shows the third part of the brake 1, namely, the cover 9. This cover 9 has a surface 36 with lateral inclined flanks 37, 37', the surface 36 having two parallel detent elements 12 and 12' which can be deflected downwardly.

Along its underside, the cover has two vertical bearing bosses 10, 10' into which fit the vertical bearing pins 8, 8' of the brake body 2. The surface 36, moreover, has a pair of tongues 45, 45' spaced from one another and overhanging the horizontal bearings 14.

Figure 10:
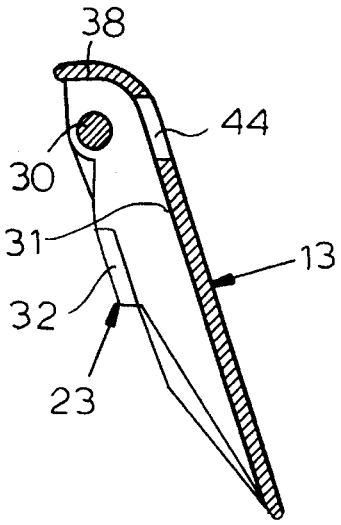
FIG. 10 is a cross sectional view taken along the line X—X of FIG. 9.

The acute plate 13 (FIGS. 9 and 10) has two horizontal pins 30 and 30' which can be spaced apart (FIG. 9) and behind which cutouts 44 and 44' are provided in the actuating plate 13. The back side 31 of the actuating plate 13 carries the spreading device 23 or 23' with its conically-shaped actuating surface 32 and, possibly, the ribs or beads 32" when the spreader has the configuration of FIG. 6. When the actuating plate 33 must be forced back into its starting position, it can have an upper region 38 forming another actuating surface which enables displacement of the actuating plate in the counterclockwise sense (FIGS. 10 and 11).

When, after the brake body 3 has been mounted in the support body 5 in step (a), the actuating plate is suspended in step (b) with its two horizontal pins 30, 30' in the horizontal bearings 14, 14' the application of the cover 9 allows the tongues 45, 45' to overhang the pins 30 and 30' and thereby prevent the lever from being lifted out of place. In this case, the pins 42 and 42' snap into openings 43 and 43' of the cover 9.

After assembly of the brake in this fashion, the housing can be inserted through the opening 41 to lock the brake in the plates in the wall 40 via the detents 6, 12, 6', 12'. Mounting can also be effected, if desired, by adhesive, other clips or a single screw or the like. What is important, of course, is that once the assembly is mounted in the spinning machine, i.e. in the wall 40, the entire brake is closed to limit contamination.

The brake can have, as has been shown, only four parts which can be assembled and disassembled readily without requiring additional fastening devices. The individual parts can be simply removed and replaced without requiring time-consuming maintenance. The complete brake unit can be mounted in various ways on the spinning machine.

It is claimed:

1. An external double-jaw brake for a spindle of a spinning machine having a spindle rail having a row of spindles and a wall extending along said rail, said brake comprising:

a support body configured to project through an opening in said wall opposite a respective spindle and provided with detents securing said support body to said wall and a pair of horizontally spaced vertical first journals;

a brake body received on said support body and comprised of a pair of mutually opposite brake levers fulcrummed at respective first and second pins on opposite sides of said brake body and interconnected at a central region of said brake body, said first pins being received in said first journals of said support body, said levers having at ends turned toward said respective spindle, respective jaws juxtaposed with and engageable with said respective spindle;

a cover overlying said brake body, extending through said opening, secured to said wall by respective detents and engaging said support body, said cover being formed with second journals aligned with said first journals and receiving said second pins; and an actuating plate suspended in horizontal pivot bearings of said support body and provided with a spreader engageable between opposite ends of said levers for spreading said levers and pressing said jaws against said respective spindle.

2. The brake defined in claim 1 wherein said support body has mutually opposite guides for the respective levers of the brake body.

3. The brake defined in claim 2 wherein each of said guides comprises two spaced apart vertical members including a relatively forwardly disposed member in a vicinity of the respective vertical first journal.

4. The brake defined in claim 3 wherein said levers of the brake body are interconnected at said central region by at least one film hinge and, rearwardly of the film hinge, each of said levers has a resilient shank formed with a respective attack surface engageable by said spreader.

5. The brake defined in claim 4 wherein two film hinges are provided at said central region to interconnect said levers.

6. The brake defined in claim 4 wherein said attack surfaces of said levers are inclined at an acute angle to one another.

7. The brake defined in claim 6 wherein each of said attack surfaces is angled and has a relatively shallowly inclined region adjoining a more steeply inclined region.

8. The brake defined in claim 6 wherein said attack surfaces have undercuts and said actuating plate has ribs engageable in said undercuts.

9. The brake defined in claim 4 wherein said actuating plate has an upper region provided with a pair of horizontal trunnions received in said pivot bearings for suspending said plate therefrom, said spreader being a block formed on a back of said actuating plate, inclined to a vertical plane and extending downwardly to a level of said attack surfaces.

10. The brake defined in claim 9 wherein a front of said actuating plate extends downwardly beyond an underside of said support body.

11. The brake defined in claim 10 wherein said block has actuating flanks extending along vertical edges of the block and engageable with said attack surfaces for camming engagement therewith.

12. The brake defined in claim 11 wherein said flanks are inclined generally conically to one another.

13. The brake defined in claim 9 wherein said actuating plate has above said trunnions a further actuating surface.

14. The brake defined in claim 3 wherein each of said levers has a shank rearwardly of the respective pins formed exteriorly with an outwardly convex spring element terminating forwardly at a respective groove receiving the respective forwardly disposed member, centrally engaging the respective other member and rearwardly reaching substantially to the other end of the respective shank.

15. The brake defined in claim 1 wherein said jaws are formed by respective brake elements fitted into the one ends of the respective levers.

16. The brake defined in claim 1 wherein said support body has a configuration of a U-shaped frame provided with the detents of said support body at a bottom of said frame.

17. The brake defined in claim 16 wherein said cover and said support body have converging surfaces tapering forwardly in a direction of insertion of said cover and said support body through said opening.

18. The brake defined in claim 17 wherein said cover and support body have mutually engageable pin and recess formations interlocking the cover with the support body.

19. The brake defined in claim 17 wherein said detents are spring tongue pairs on the cover and the support body lying in a common vertical plane.

20. The brake defined in claim 17 wherein said cover has a pair of guide formations extending through openings in the actuating plate above said trunnions.

21. The brake defined in claim 1 wherein said cover extends over the central region of said brake body substantially to said other ends of said levers.

* * * * *